US005188467A

United States Patent [19]

Yamamoto et al.

[11] Patent Number: 5,188,467

[45] Date of Patent: Feb. 23, 1993

[54] PRINT HEAD WITH ENERGIZING AND RETURN LEAF SPRINGS

[75] Inventors: Tetsuya Yamamoto, Higashimurayama; Yukio Endoh, Kawagoe; Akio Segawa, Saitama; Kenji Matsumoto, Tokyo; Takeo Komiyama, Hoya, all of Japan

[73] Assignee: Citizen Watch Co., Ltd., Tokyo, Japan

[21] Appl. No.: 713,211

[22] Filed: Jun. 11, 1991

[30] Foreign Application Priority Data

Jun. 16, 1990 [JP] Japan ..... 2-63866[U]
Jun. 16, 1990 [JP] Japan ..... 2-63867[U]

[51] Int. Cl.[5] ..... B41J 9/36
[52] U.S. Cl. ..... 400/157.2; 400/124
[58] Field of Search ..... 400/124, 121, 157.2, 400/157.3; 101/93.05, 93.04, 93.29, 93.34, 93.48

[56] References Cited

U.S. PATENT DOCUMENTS

| | | | |
|---|---|---|---|
| 4,389,127 | 6/1983 | Bellinger | 400/124 |
| 4,624,589 | 11/1986 | Ochiai et al. | 400/124 |
| 4,986,179 | 1/1991 | Moriya et al. | 400/124 |
| 4,986,676 | 1/1991 | Kimura et al. | 400/124 |

FOREIGN PATENT DOCUMENTS

| | | | |
|---|---|---|---|
| 52-46929 | 4/1977 | Japan . | |
| 82061 | 5/1982 | Japan | 400/124 |
| 95479 | 6/1982 | Japan | 400/124 |
| 126672 | 8/1982 | Japan | 400/124 |
| 173177 | 10/1982 | Japan | 400/124 |
| 203566 | 12/1982 | Japan | 400/124 |
| 90965 | 5/1983 | Japan | 400/124 |
| 111865 | 6/1984 | Japan | 400/124 |
| 61-121958 | 6/1986 | Japan . | |
| 148070 | 7/1986 | Japan | 400/124 |
| 227066 | 10/1986 | Japan | 400/124 |
| 62-242549 | 10/1987 | Japan . | |

*Primary Examiner*—David A. Wiecking
*Attorney, Agent, or Firm*—Lowe, Price, Leblanc & Becker

[57] ABSTRACT

A print head is provided with armatures, each having a stylus section and a plunger in an opposite position, the armatures each having the middle section that serves as a fulcrum for rotation. A plurality of first flat springs act on the armatures to that the armatures are biased in direction bias the armatures in a direction returning the armatures against the bias forces by the first flat springs.

8 Claims, 6 Drawing Sheets

PRINT HEAD WITH ENERGIZING AND RETURN LEAF SPRINGS

TECHNICAL FIELD

This invention relates to improvements to a print head.

BACKGROUND OF THE INVENTION

A print head of a dot printer, based on a wire style, is disclosed, for instance, in Japanese Patent Laid-open No. 52-46929 and Japanese Patent Laid-open No. 61-121958, wherein a printing operation is performed by hitting a base section of a print wire with a tip of an armature fluctuated and driven by excitation of a solenoid and making a wire tip thrust from the print head. Another type, based on a stylus style as disclosed, for instance, in Japanese Patent Laid-open No. 62-242549, wherein an armature with a stylus is mounted via a flat spring onto a basic body of the print head in a manner allowing fluctuation and printing operation is performed by fluctuating and driving this armature by excitation of a solenoid and making a stylus of said armature thrust from the print head.

The print head based on a wire style has a defect that when a wire guide hole formed on the print head or the wire is worn a mating state between the wire guide hole and the print wire becomes loose and it becomes harder to maintain the initial precision in dot positioning. In other words, in this style, it is possible to realize an extremely high precision in dot positioning by making higher working precision of the wire guide, but it is difficult to maintain the dot positioning precision for a long time.

In a print head based on a suction stylus style, fluctuation of an armature is restricted by a flat spring connecting a basic body of the print head to the armature, and additionally it is rare for a flat spring which repeats simple flexing movement to wear or get permanently deformed, so that the print head base on this style has more excellent durability than that of a print head based on wire style and the initial dot positioning precision can be maintained for a long time.

In this conventional style, as the flat spring is flexed in the reverse direction when the armature is in a hitting position for printing, because of a force working from a side of the armature, the flat spring may be distorted. In other words, a force on the flat spring, which has been flexed and is forming a secondary curved surface from a direction different from the flexing direction, causes distortion of the flat spring. In brief, in the print head based on the conventional suction stylus style, it is possible to maintain the initial dot positioning precision for a long time, but as the initial dot positioning precision includes a horizontal deflection error of the armature associated with distortion of the flat spring, a precision in repetition of the initial dot positioning itself has a problem.

Also, in a spring charge stylus style, wherein a flat spring is flexed by a permanent magnet to keep an armature in a stand-by position and printing operation is performed by fluctuating and driving this armature by excitation of a solenoid, the flat spring becomes flat in a hitting position for printing, and a horizontal deflection error of the armature associated with distortion of the flat spring is small. However, as it is necessary to form a permanent magnet for maintaining the armature in a stand-by position, production cost of the print head is expensive, which is a defect of this system.

Another problem is that, as it is necessary to maintain a hitting force at each wire and a print edge of the stylus at a constant level in relation to all armatures, it is necessary to maintain a final driving force working to the print wire and the stylus at a constant value by maintaining both of a fluctuation stroke of an armature connected to the print wire for thrusting action or an armature with stylus, or in other words a fluctuation and energization range of an armature energized by excitation of the core and an air gap between a plunger and a core absorption surface, of in other words an energizing force working to the armature by excitation of the core at a constant level respectively.

Factors which decide a fluctuation stroke or an air gap of an armature depend mainly on the precision of the parts themselves, e.g., the support member which supports the armature, the core which fluctuates and drives the armature by sucking a plunger section, and the armature stopper which restricts a stand-by position of the armature. Also important are the working precision of the mounting surface to which the parts are mounted. In the conventional types of print head, the mounting surface on which the parts are mounted is extended to surfaces of various members building a print head. Even with excellent working precision of the parts themselves of the mounting surface, an accumulated error related to forms and dimensions of the members to which the parts are mounted may give rise to a fluctuation or an air gap of the armature, hence it is very difficult to maintain the precision at a satisfactory level.

SUMMARY OF THE INVENTION

A principal object of this invention is to provide a print head which makes it possible to correctly maintain the initial dot positioning for a long time and insures precision of an armature's fluctuation stroke or air gap, thus providing excellent print quality.

A print head according to the preferred embodiment of this invention comprises an armature using its middle section as a rotation fulcrum and having a stylus section and a plunger, a first flat spring energizing the aforesaid armature so that said armature is energized in the direction of hitting for printing, and a second flat spring energizing in direction of returning the aforesaid armature in stand-by position against an energizing force of the first flat spring.

The first flat spring is set in the original flat position which is parallel to a surface of the armature's surface on which the plunger is mounted, when the armature is in a hitting position for printing, displacement to a side way which is caused by deformation of the flat spring itself is not generated. Most of the force working from a side of the armature works to inside of a plane of the first flat spring, and the flat spring shows a sufficient resistance against a force which works to inside of the plane of the flat spring, so that torsion of the first flat spring supporting the armature is not generated, sideward deflection of the armature fixed to a tip of the first flat spring is prevented, and repetition precision of dot positioning of the stylus is maintained. As the first flat spring is never deformed permanently, the initial positioning precision is maintained for a long time.

The first flat spring which presses and keeps the armature in a stand-by position is formed with a flat on, so that dispersion of elasticity of the flat spring due to an error associated with bending when the flat spring is manufactured is eliminated, the force to keep the armature in a stand-by position is kept at a constant level, the hitting force for printing of each armature excited and driven against the aforesaid force is kept at a constant level, thus stable print quality being obtained. As it is not necessary to use a permanent magnet to keep an armature in a stand-by position like in the conventional spring charge stylus style, a print head can be built at a low cost.

As styluses for each armature are allocated in a rhombus form, it is possible to more minimize a print head configuration.

As an attract surface of the core, an armature stopper mounting surface, and an armature supporting member mounting surface are formed on the same surface on the solenoid body, accumulated errors for the forms and dimensions between the mounting surfaces is excluded, and as the armature stopper and the armature supporting member are tightly mounted on each mounting surface respectively without being supported by any other member, precision of the armature's fluctuation stroke and precision of an air gap between the plunger section and the core's attract surface are fully insured, thus both of a fluctuation/energization range of each armature and an energizing force working to each armature being kept at constant levels, the final driving force working to the print wire and the stylus being at a constant values, and excellent print quality without any dispersion in print density being obtained.

DETAILED DESCRIPTION OF THE PREFERRED EMBODIMENTS

Figure 1:
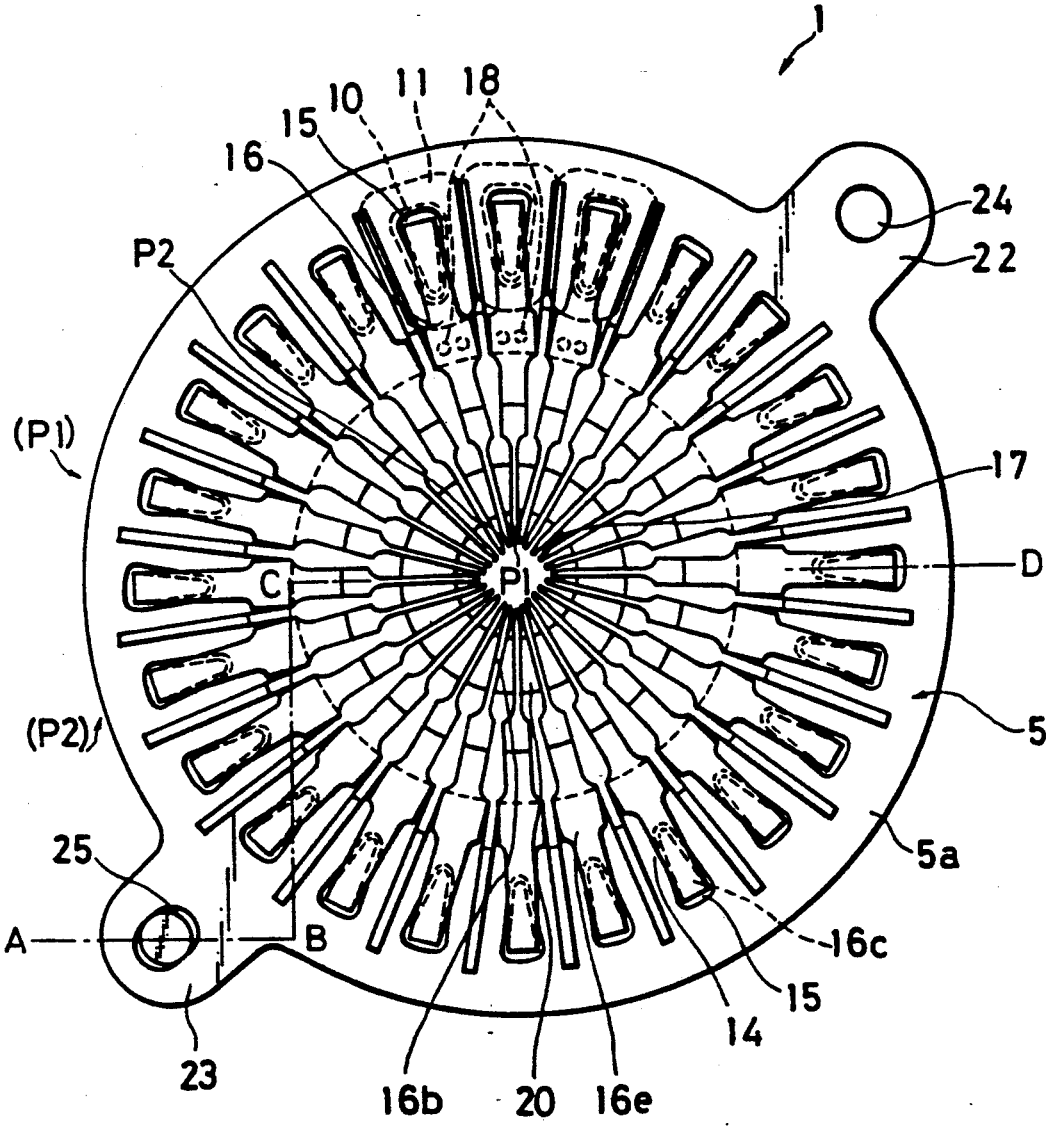
FIG. 1 is a top view showing key sections of this print head.
Figure 2:
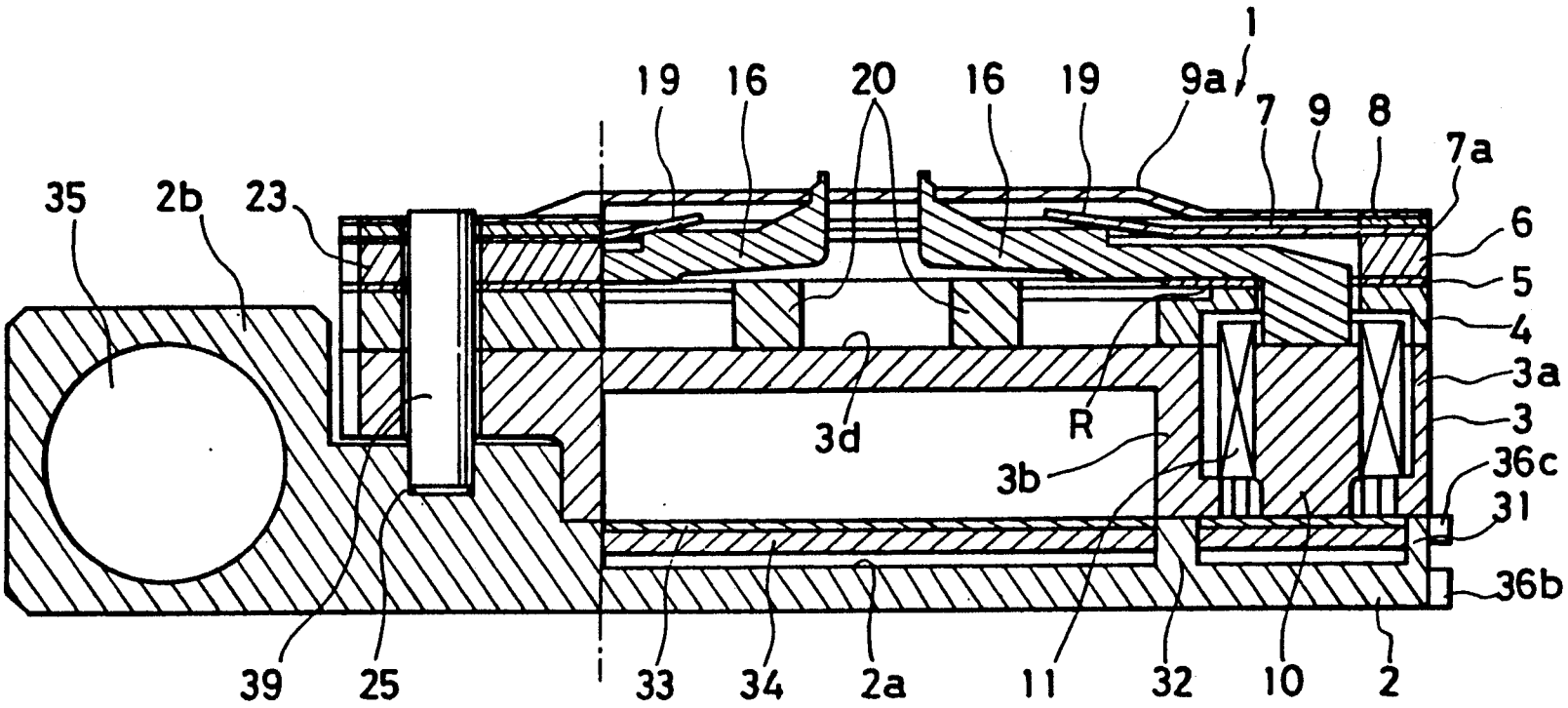
FIG. 2 is a cross-sectional drawing of the print head.

In FIGS. 1 and 2, a print head 1 is formed by assembling a solenoid body 3, a side yoke 4, a first flat spring body 5, a first spacer 6, a second flat spring body 7, a second spacer 8, and a stylus mask 9 on a rear cover 2.

Figure 7:
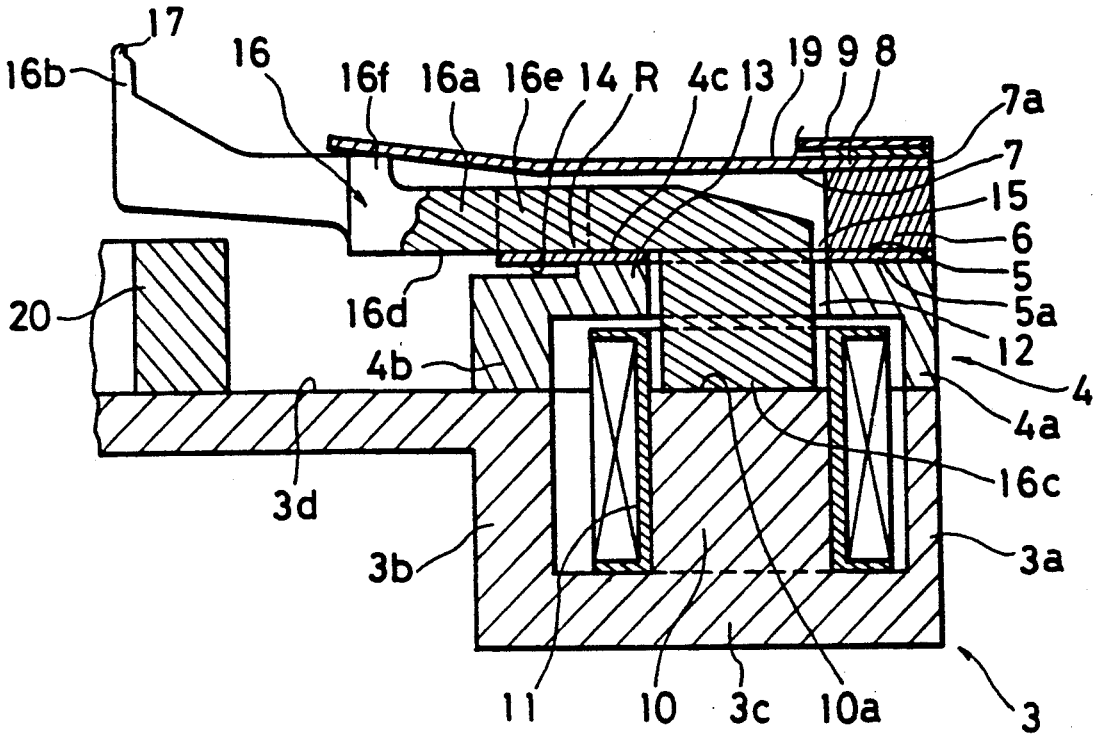
FIG. 7 is a partially enlarged cross-sectional view of FIG. 2.

As shown in FIG. 2 and FIG. 7, the solenoid body 3 comprises an external yoke 3*a* formed along a ring-form wall and an internal yoke 3*b*, a bottom surface 3*c* which communicates the external yoke 3*a* and the internal yoke 3*b* at their lower edges to form a circular groove. A communicating plate 3*d* (best seen in FIG. 2) communicates with the inside an upper edge section of the ring-form wall of the internal yoke 3*b*, and on the bottom surface forming the circular groove are formed cores 10 each with a top cross-section like a fan along a pheriphery of the bottom surface 3*c* at a specified pitch, and a bobbin 11 around which coil 11 is wound is mounted on each of the cores 10. The external yoke 3*a*, the internal yoke 3*b*, the bottom surface 3*c*, the communicating plate 3*d* and the core 10 are integrated into a body as the solenoid body 3, and an upper edge of each of the external yoke 3*a* and the internal yoke 3*b*, an attract surface 10*a* of the core 10, and a top surface of the communicating plate 3*d* are formed by means of, for instance, surface grinding, so that they are disposed in the same plane as the solenoid body 3.

The side yoke 4 overlaid on the top surface of the solenoid 3 is, as shown in FIG. 7, a ring-form body having peripheral walls 4*a* and 4*b* with the lower edges engaged with the upper edges of the external yoke 3*a* and the internal yoke 3*b*, and on a top surface 4*c* of the ring-form body through holes 12 are pierced, each of which has a cross-sectional form approximately like the attract surfaces 10*a* of the cores 10, corresponding to the cores 10 on the solenoid body 3, and furthermore a ring-form thrusting section 13, which forms an armature supporting member 13 in the upper section of the peripheral walls 4*a* and 4*b* so that said member places these through-holes 12 between inside and outside of the ring-form in the radial direction thereof, and an internal angular section R of the ring-form thrusting section becomes a fulcrum of the first flat spring 19 which supports an armature 16.

The first flat spring body 5 laid on a top surface of the side yoke 4 has, as shown in FIG. 1 and FIG. 7, a plurality of first flat springs each thrusting from the ring-form periphery to a center thereof, in other words first flat springs 14. Note that the flat spring body 5 including the first flat springs 14 is formed on the same plane. On each of the flat springs 14 arranged on the periphery section 5*a* is arranged a through hole 15 having an approximately similar cross-section to the suction surface 10*a* of the core 10, corresponding to the core 10 of the solenoid body 3.

As shown in FIG. 7, an armature 16 makes an stylus section 16*b* and a plunger 16*c* project to a position reverse to both edges of an armature body 16*a* in the longitudinal direction thereof. The armature body 16*a*, stylus section 16*b*, and the plunger 16*c* form an integral unit formed by means of injecting metal based on iron-cobalt alloy, and the section of stylus 16*b* is plated with nickel phosphor plating for curing. Materials having an excellent electricity/magnetism coversion efficiency as well as excellent vibrationproofing characteristic are used as raw materials for the iron-cobalt alloy, and furthermore the abrasion resistance of the stylus section 16*b* is high because of curing with nickel phosphor plating. Also, because of fabrication using metal injection, flexibility in designing a cross-sectional form of a print edge 17 in the stylus section 16*b* is substantially improved, and for instance, the cross-sectional form of the print edge may be a rectangle with one edge of 0.2 mm. A cross-section of the plunger 16*c* formed at one edge of the armature body 16*a* has a similar form to a cross-section of the attract surface 10*a* in the core 10, and the outer diameter thereof is a little smaller than diameters of the through-hole 12 pierced in the side yoke 4 and the through-hole 15 pierced in the first flat spring 14.

The plunger 16*c* is located in a manner allowing fluctuation, assuming the inner angular section R of the ring-form thrusting section 13 as a fulcrum which is a center for fluctuation of the armature 16, on the ring-form thrusting section 13 which goes through the through-hole 15 pierced in the first flat spring 14 and the through-hole 12 pierced in the side yoke 4 and faces the attract surface 10*a* of the core 10 arranged on the solenoid body 3, and wherein the lower surface of the basic section of the armature body 16*a*, or in other words a central section of the plunger mounting surface 16d in the longitudinal direction thereof is formed with the first flat spring 14 integratedly on the top surface 4c of the side yoke 4, in brief the armature supporting member. A tip of the first flat spring 14 extending along the longitudinal direction of the armature 16 in parallel to the plunger mounting surface 16d goes beyond the fluctuation center of the armature 16 up to a middle section 16e of the armature 16 near the fluctuation center. The first flat spring 14 is welded at two points 18, as shown in FIG. 1, to the plunger mounting surface 16d in this middle section 16e, thus fixed to the armature 16. In other words, the first flat spring 14 is a flat plane spring, a tip of which is fixed, when the armature 16 is in a hitting position for printing, near the fulcrum of fluctuation of the armature 16, and which extends along the longitudinal direction of the armature 16 in parallel to the plunger mounting surface 16d, and an outer edge thereof is integrated with the periphery section 5a, so that any deformation or torsion does not occur between first flat spring 14 and the aforesaid periphery section 5a. No restriction is added to the first flat spring in hitting for printing.

Figure 6:
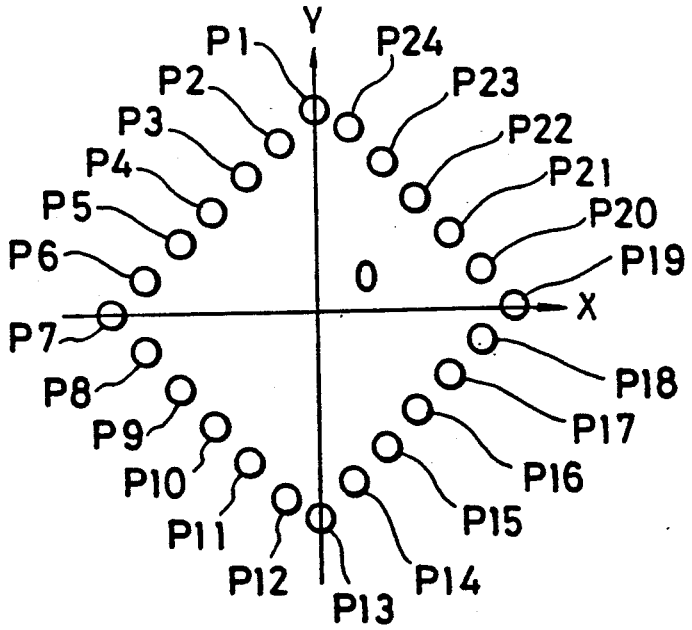
FIG. 6 is a drawing showing arrangement of styluses on the print head.

FIG. 6 is a drawing which shows a mounting state of a print edge 17 on the stylus section 16b arranged in each armature 16 in correspondence to FIG. 1, and the X axis shown in FIG. 6 corresponds to the direction of cross-section C-D in FIG. 1. In other words, when a pin at the print head 17 of the stylus section 16b which is located in the utmost top section of FIG. 1 is defined as P1, and subsequent pins in each armature 16 as P2,P3, . . . P24 in the counterclockwise direction in FIG. 1, and if it is assumed that a center of the entire armatures 16 arranged in a radial form is an origin of coordinates in FIG. 6 and the unit range on this coordinate system is U mm, location of the print edge of each armature 16, an X directional range and a Y directional range of Pn+1 in relation to Pn are as shown in Table 1, and styluses for each armature are arranged in a rhombus form as a whole, and additionally the print edges 17 of armatures for pin P1 and pin P13 are on the Y axis crossing the X direction in which the print edges moves when printing each line, at right angles.

When welding the armature 16 to the first flat spring 14, using an appropriate jig to termporally fix said armature 16, each of the armatures 16 is positioned with each other so that the arrangement of the print edges 17 is as shown in Table 1, and then the first flat spring body 5 is relatively positioned to the jig, placed on the plunger mounting surface 16d of the armature 16, and welded at the spots 18.

TABLE 1

| | Stylus Mounting Positions | | | |
|---|---|---|---|---|
| | Location (× U mm) | | Pitch (× U mm) | |
| Pin | X | Y | X | Y |
| P1 | 0 | 23 | | |
| P2 | −4 | 19 | −4 | −4 |
| P3 | −8 | 15 | Same as above | Same as above |
| P4 | −12 | 11 | Same as above | Same as above |
| P5 | −16 | 7 | Same as above | Same as above |
| P6 | −20 | 3 | Same as above | Same as above |
| P7 | −24 | −1 | Same as above | Same as above |
| P8 | −20 | −5 | 4 | Same as above |
| P9 | −16 | −9 | Same as above | Same as above |
| P10 | −12 | −13 | Same as above | Same as above |
| P11 | −8 | −17 | Same as above | Same as above |
| P12 | −4 | −21 | Same as above | Same as above |
| P13 | 0 | −23 | Same as above | −2 |
| P14 | 4 | −19 | Same as above | 4 |

TABLE 1-continued

| | Stylus Mounting Positions | | | |
|---|---|---|---|---|
| | Location (× U mm) | | Pitch (× U mm) | |
| Pin | X | Y | X | Y |
| P15 | 8 | −15 | Same as above | Same as above |
| P16 | 12 | −11 | Same as above | Same as above |
| P17 | 16 | −7 | Same as above | Same as above |
| P18 | 20 | −3 | Same as above | Same as above |
| P19 | 24 | 1 | Same as above | Same as above |
| P20 | 20 | 5 | −4 | Same as above |
| P21 | 16 | 9 | Same as above | Same as above |
| P22 | 12 | 13 | Same as above | Same as above |
| P23 | 8 | 17 | Same as above | Same as above |
| P24 | 4 | 21 | Same as above | Same as above |

Upper and lower inner peripheries of a first spacer 6 which is laid over the first flat spring body 5 are fulcrums for the two flat springs 19 and 14 corresponding to 24 pieces of armatures 16, which are formed with straight line sections crossing a longitudinal direction of each of the flat springs 19 and 14. Furthermove, a second flat spring body 7 is laid on the upper face of the spacer 6.

The first spacer 6 laid on the upper surface of the first flat spring 5 is a ring-form body, and furthermore the second flat spring body 7 is laid on the upper surface of the spacer 6.

As shown in FIG. 7, the second flat spring 7 has a plurality of second flat springs 19 which extend from the ring-form base section 7a toward a center thereof. Each flat spring 19 extends over a fulcrum for fluctuation of the armature 16 and presses at its tip the projecting section 16f of the armature 16. The armature 16 is energized (in the counterclockwise direction in FIG. 7) with the inner angular section R of the ring-form thrusting section 13 of the side yoke 4 as a fulcrum, and the armature 16 is kept in a stand-by position where said armature 16 is restricted by an armature stopper 20.

Each second flat spring 19 consists of a plane form spring. Pressing forces are exerted by the flat springs 14 and 19 to a projecting section 16f of the armature 16 from the plunger mounting surface 16d, and thickness are the first spacer 6, and are adjusted by maintaining in a state where a tip of the armature 16 is pressed to the armature stopper 20 and bending the first flat spring 14 with the pressing force thereof. A hitting force of the armature 16 for printing is defined by a pressing force of the second flat 19 which works to rotate the armature 16 counterclockwise around the internal of the ring-form projecting section 13 of the side york 4, a restoring force by the first spring 14 against the aforesaid force, and an attracting force of a solenoid consisting of the core 10 and the bobbin 11. However, as the first flat spring 14 and the second flat spring 19 consist of a plane form spring respectively, a pressing force by each flat spring does not vary due to dispersion of a working error generated during a bending fabrication process like that which may occur in curved springs. Hence the hitting force of the armature 16 for printing is maintained at a constant level.

The armature stop 20 which contacts a rear surface of the stylus section 16b and restricts a stand-by position of said armature 16 is, as shown in FIG. 7, fixed to the communicating plate 3d of the solenoid body 3 at a position nearer to the stylus section 16b than to the fluctuation fulcrum R of the armature 16 in the longitudinal direction of the armature 16. The upper surface of the communicating plate 3d, on which the armature stopper 20 is mounted, upper edges of the external yoke 3a and the internal yoke 3b, on which the side yoke 4 is mounted, and the attarct surface 10a of the core 10 are formed on the same surface as the solenoid 3, and furthermore the armature stopper 20 and the side yoke 4 are tightly fitted to the mounting surface respectively, so that a hitting stroke of each of the armatures 16 and an air gap between the plunger 16c and the attract surface 10a can be kept at a constant level respectively. Other than the working precision of each of the armatures 16, the precision of the hitting stroke and the precision of the air gap depend on the accumulated errors in the working precision of the armature stopper 20 which mates with said armature 16, the side yoke 4, and members forming the attract surface 10a. However, as the attract surface 10a is formed on the same plane as the mounting surface for the armature stopper 20 and the side yoke 4, the accumulated errors among the armature stopper 20, the lower edge of the side yoke 20, and the attract surface 10a are virtually eliminated and the element that has an influence over precision of the hitting stroke for printing and precision of the air gap is only the change in height of the side yoke forming the armature stopper 20 and the armature supporting member. The side yoke 4 and the armature stopper 20 are bodies having a simple ring form respectively, which are members common to all of the armatures 16, so that factors giving an influence over precision of the hitting stroke and the air gap can be reduced to virtually only working precision of each of the armatures 16 by applying a surface grinding processing to the ring-form projecting section 13 which is an armature supporting member, lower edges of the peripheral walls 4a and 4b, and upper and lower surfaces of the armature stopper 20. For this reason, precision of the hitting stroke or the air gap is fully insured, a projecting limit of the stylus section 16b in each armature 16 and an excited and energized range of the armature 16 restricted by the hitting stroke are kept at a constant level respectively, thus excellent positioning precision in the hitting direction and a stable hitting force being realized. Especially as for the hitting force for printing, an extremely stable fitting force for printing is insured, in addition to because of a constant excitation/energization range of each of the armatures 16, because a force input to each of the armatures 16 is kept at a constant level by the first flat spring 14 and the second flat spring 19.

The second spacer 8 which is laid on the upper surface of the second flat spring body 7 is a ring-form body which fixes the second flat spring 7, and furthermore the stylus mask 9 is laid on the upper surface of the spacer 8.

Figure 3:
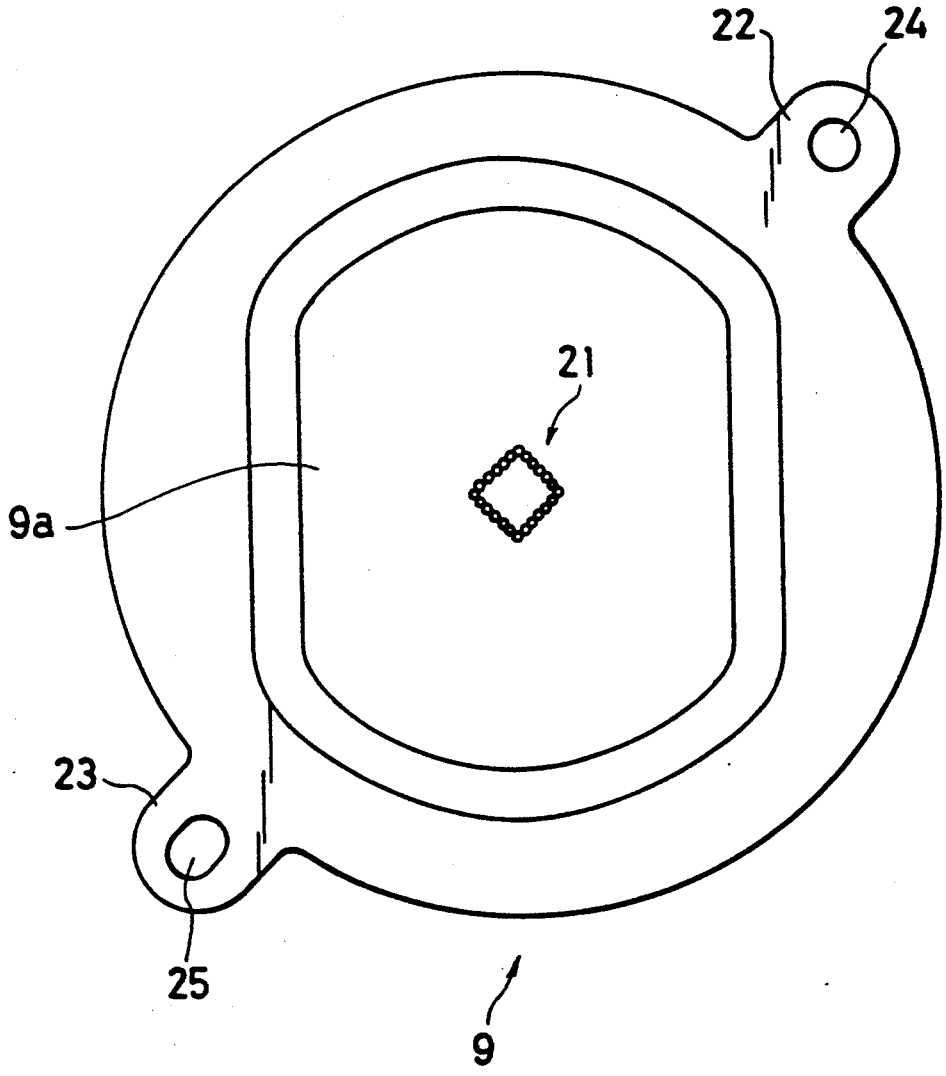
FIG. 3 is a top view showing a stylus mask.

As shown in FIG. 2 and FIG. 3, the stylus mask 9 is a plate-like body having an expanding section 9a projecting upward, and at an approximately central section is arranged a stylus projecting hole 21 pierced in correspondence to arrangement of the stylus 16a.

Figure 4:
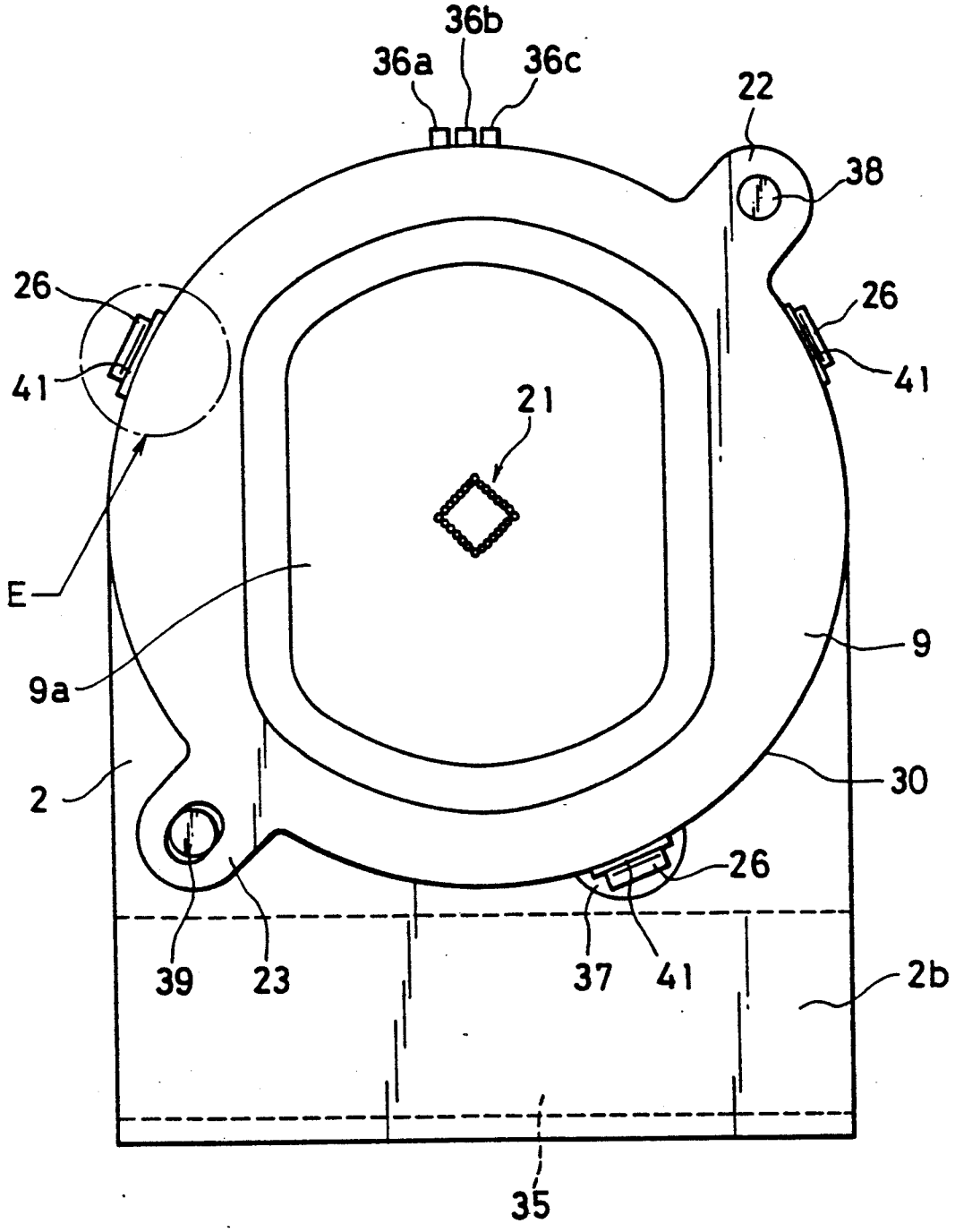
FIG. 4 is a top view showing the print head when assembled.

In the external side of each of the solenoid body 3, the side yoke 4, the first flat flat spring body 5, the first spacer 6, the second flat spring body 7, the second spacer 8 and the stylus mask 9 are formed the projecting sections 23 and 23 with holes 24 and 25 pierced in it respectively in an integral unit. As shown in FIG. 1 and FIG. 4, the projecting sections 22 and 23 are located on a diagonal line of a virtual rectangle formed by 4 edges crossing at right angles and in parallel to the moving direction when printing each line (Direction CD in FIG. 1), and the mating pieces formed on the projecting sections 22 and 23 and the rear cover 2 do not thrust out from this virtual rectangle.

The rear cover 2 is a rectangular plate-like body as shown in FIG. 4, and on the overlaying surface with the solenoid body 3 are formed mating and projecting pieces 31 and 32 closely fitted to the lower edges of the external yoke and the internal yoke 3b of the solenoid body 3, as shown in FIG. 2, to form a clearance between the solenoid body 3 and the overlaying surface 2a. A circuit board 34 communicated to the solenoid body 3 and an insulation member 33 are mounted in a clearance formed between the solenoid body 3 and the rear cover 2. The projecting section 2b arranged in one side of the rear cover 2 is formed thick with a through-hole 35 formed therein for a guide rod (not shown), which runs the print head in the moving direction when said print head prints each line, to pierce through, and in another side of the rear cover are arranged rail guides 36a,36b, and 36c to suppress fluctuation of the rear cover 2 around the guide rod to hold rails (not shown) arranged in parallel to the guide rod. In a hole 37 in the rear cover 2 along a periphery thereof is formed the mating piece 26 which mates with a hole 41a in a fastener 49 shown in FIG. 5, and blind holes are pierced at positions corresponding to the holes 24 and 25 in the projecting sections 22 and 23 formed on each member.

The solenoid body 3, the side yoke 4, the first flat spring body 5, the first spacer 6, the second flat spring body 7, the second spacer 8, and stylus mask 8 are positioned on the upper surface of rear cover sequentially in an overlaying position, and as shown in FIG. 2 and FIG. 4, positioning among each member is performed by setting a first positioning pin 38 in holes 24 of the projecting section 22 arranged on each member and setting a second positioning pin 39 in the hole 25. Accordingly, the solenoid body 3 equipped with the communicating plate 3d which serves as a mounting surface for the armature stopper 20 and the attract surface 10a of the core 10, the side yoke 4 equipped with the ring-form attract section 13 which serves as an armature supporting member, and the first flat spring body 5 on which the armature 16 is mounted are accurately positioned also in the sideward direction, so that a position of the fluctuation fulcrum for the armatures 16 is constant to all of the armatures and precision of the hitting stroke of the armatures 16 or the air gap can be maintained more accurately.

What is described above relates to an example of a print head based on a stylus print style, but configuration of this invention to eliminate an accumulated error by a mounting surface of an armature stopper and an armature supporting member and an attract surface of the core in the same plane can be applied to all types of print head, irrespective of whether based on the wire print style or on the stylus print style, on the condition that the armature is equipped with a core and an armature stopper in one side of the armature and has an armature supporting member.

Figure 5:
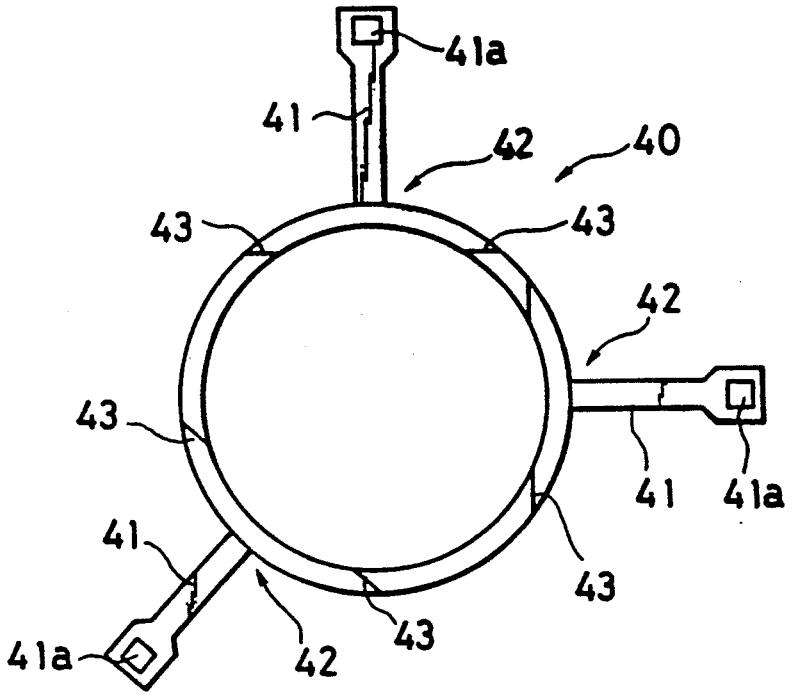
FIG. 5 is a top view showing a fastner for the print head.

FIG. 5 is a top view showing the fastener 40 forming a belt-like coupling means, wherein holes 41a which mate with the mating pieces 26 of the rear cover 2 are arranged at tips of the 3 belt bodies formed as part of the ring-form section.

Figure 8:
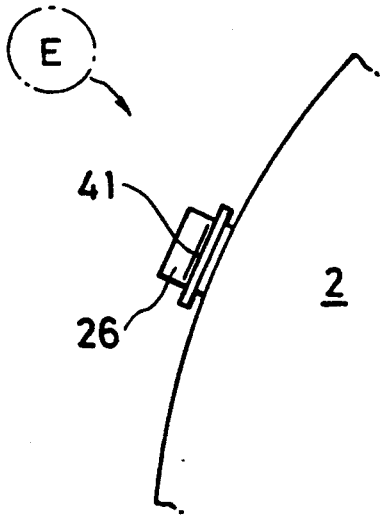
FIG. 8 is a detail drawing of the section E in FIG. 4.

Bending at line 43 (as best seen in FIG. 5) is applied to the ring-form section for elasticity effect, and in the fastener 40, each section 42 of the body 41 is bent approximately at right angles, and the ring-form section is fixed by mating the holes 41a of the belt bodies 41 with the mating pieces 26 of the rear covers (shown in FIG. 4 and FIG. 8) and pressing all of the members allocated on the upper surface of the rear cover 2. In brief, the solenoid body 3, the side yoke 4, the first flat spring body 5, the first spacer 6, the second flat spring body 7, the second spacer 8, and the stylus mask 9 to the rear cover 2.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

We claim:

1. A print head, comprising:

a plurality of armatures each having a stylus and a plunger at opposite ends and a fulcrum provided therebetween to enable rotation of the armature thereat;

a first flat spring body, having a plurality of leaf portions for respectively attaching to one of said armatures in the vicinity of the corresponding fulcrum thereof, each leaf portion being disposed to elastically return the corresponding armature to a hitting position thereof for printing thereby;

a second flat spring body, having a plurality of second leaf portions, each of said second leaf portions being disposed to coact with a respective one of said armatures so as to elastically bias the same away from the hitting position thereof to a standby position; and a plurality of solenoids disposed and actuable for independently attracting a corresponding one of said armatures to the hitting position thereof.

2. A print head according to claim 1, further comprising:

an armature stopper for engaging with said styluses for defining said standby positions of said armatures; and an armature supporting member for supporting said first flat spring body and defining locations for the fulcrums of said armatures, wherein each of said solenoids comprises a solenoid body having a core and an attracting surface of the core for attracting a corresponding plunger, wherein said attracting surfaces of said cores, a first surface for mounting said armature stopper and a second surface for mounting said armature supporting member are all disposed to be coplanar, and wherein said armature stopper and said armature supporting member are tightly fitted respectively to said first and second mounting surfaces therefor.

3. The print head according to claim 2, wherein:

armature supporting member has a ring-form projecting section in an upper section thereof and an upper surface of the ring-form projecting section contacts the said first flat spring body.

4. The print head according to claim 1, wherein:

said first flat spring body and said armatures are fixed relative to one another.

5. The print head according to claim 1, wherein:

said first flat spring body is formed with a plurality of apertures, and said plungers each pass through a respective one of said apertures.

6. The print head according to claim 1, further comprising:

a spacer arranged between said first flat spring body and said second flat spring body.

7. The print head according to claim 1, wherein;

said second leaf portions press said armatures so that said armatures are held in stand-by positions thereof against a biasing force of the first flat spring.

8. The print head according to claim 1, wherein:

the styli are arranged in a rhombus form.

* * * * *